US007722118B2

(12) United States Patent
Bapst et al.

(10) Patent No.: US 7,722,118 B2
(45) Date of Patent: May 25, 2010

(54) REPOSITIONABLE CHILD SUPPORT DEVICE

(75) Inventors: David M. Bapst, South Wales, NY (US); Emily Schoenfelder, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 42 days.

(21) Appl. No.: 11/680,919

(22) Filed: Mar. 1, 2007

(65) Prior Publication Data

US 2007/0205646 A1 Sep. 6, 2007

Related U.S. Application Data

(60) Provisional application No. 60/778,065, filed on Mar. 2, 2006.

(51) Int. Cl.
*A47C 3/02* (2006.01)

(52) U.S. Cl. ..... 297/256.12; 297/260.2; 297/256.16

(58) Field of Classification Search ..... 297/256.1, 297/256.12, 256.14, 256.16, 260.2
See application file for complete search history.

(56) References Cited

U.S. PATENT DOCUMENTS

| | | | |
|---|---|---|---|
| 43,972 | A | 8/1864 | Coldwell |
| 100,083 | A | 2/1870 | Stephan |
| 383,868 | A | 6/1888 | Davey |
| 616,697 | A | 12/1898 | Cowles et al |
| 742,932 | A | 11/1903 | Tuttle |
| 1,360,495 | A | 11/1920 | Bugenhagen |
| 1,439,478 | A | 12/1922 | Maynes |
| 1,686,145 | A | 10/1928 | Guy |
| 1,707,167 | A | 3/1929 | Marshall |
| 1,731,658 | A | 10/1929 | Gnuechtel |
| 1,874,345 | A | 8/1932 | Parrott |
| 1,940,679 | A | 12/1933 | Fleming |
| 1,952,768 | A | 3/1934 | McGowen |
| 2,092,082 | A | 9/1937 | Oermann |
| 2,271,440 | A | 1/1942 | Nelems |
| 2,302,950 | A | 11/1942 | Parsons |
| 2,371,384 | A | 3/1945 | Dyer, Jr. |
| 2,506,890 | A | 5/1950 | Pratt |
| 2,510,223 | A | 6/1950 | Hart |
| 2,616,485 | A | 11/1952 | Robbins |
| 2,704,111 | A | 3/1955 | Wunderlich |
| 2,916,745 | A | 12/1959 | Lesk et al. |

(Continued)

FOREIGN PATENT DOCUMENTS

| | | |
|---|---|---|
| DE | 2421474 | 11/1975 |

(Continued)

OTHER PUBLICATIONS

Fisher-Price Baby Gear, Nature's Touch™ Baby Papasan™ Cradle Swing, 2008 Mattel, Inc., Dec. 4, 2008.

*Primary Examiner*—Sarah B McPartlin
(74) *Attorney, Agent, or Firm*—Edell, Shapiro & Finnan, LLC

(57) ABSTRACT

An infant glider device is disclosed. The glider includes a base, a carriage that moves in an oscillatory motion along a predetermined path with respect to the base, and seat connected to the carriage. The seat is rotationally repositionable about an axis generally perpendicular to the carriage, and is adapted to be reoriented from a first seat facing position to a second seat facing position, and vice versa.

20 Claims, 10 Drawing Sheets

U.S. PATENT DOCUMENTS 2,961,666 A 11/1960 Finger
3,147,972 A 9/1964 Borsuk
3,350,134 A 10/1967 Kotler
3,391,932 A 7/1968 Scalf
3,718,365 A * 2/1973 Gibson ..... 297/344.24
3,758,156 A 9/1973 Zawadzki
3,829,086 A 8/1974 Lelong
3,994,468 A 11/1976 Carter et al.
4,072,318 A 2/1978 Laune
4,155,548 A 5/1979 Smith et al.
4,190,248 A 2/1980 Philippi
4,226,467 A 10/1980 Boudreau
4,258,446 A 3/1981 McAllister et al.
4,383,714 A 5/1983 Ishida
4,448,410 A 5/1984 Kosoff
4,516,806 A 5/1985 McDonald et al.
4,615,059 A 10/1986 Darowski
4,620,334 A 11/1986 Robinson
4,752,980 A 6/1988 Nafte
4,793,010 A 12/1988 Gross et al.
4,805,902 A 2/1989 Casagrande
4,856,130 A 8/1989 Berkovich
4,911,499 A 3/1990 Meeker
4,934,997 A 6/1990 Skakas
4,957,302 A 9/1990 Maxwell
4,970,740 A 11/1990 Crawford
5,099,528 A 3/1992 Wadman
5,115,523 A 5/1992 Cone
5,123,701 A 6/1992 Bottamiller et al.
5,183,312 A * 2/1993 Nania ..... 297/256.12
5,253,921 A 10/1993 Boulet
5,277,472 A 1/1994 Freese et al.
5,303,433 A 4/1994 Jang
5,398,353 A 3/1995 Sachathamakul
5,403,239 A 4/1995 Zimmers
5,451,093 A 9/1995 Petrie et al.
5,463,961 A 11/1995 Graves
5,464,381 A 11/1995 Wilson
5,527,096 A 6/1996 Shimer
5,562,548 A 10/1996 Pinch et al.
5,603,551 A 2/1997 Sheehan
5,615,428 A 4/1997 Li
5,618,016 A 4/1997 Garland et al.
5,685,778 A 11/1997 Sheldon
5,688,211 A 11/1997 Myers
5,707,294 A 1/1998 Fischer
5,765,913 A 6/1998 LaPointe et al.
5,803,817 A 9/1998 Stern
5,833,545 A 11/1998 Pinch et al.
5,890,762 A 4/1999 Yoshida
5,935,012 A 8/1999 Cohn
5,967,609 A 10/1999 Potter
6,027,409 A 2/2000 Favorito et al.
6,056,357 A 5/2000 Fukuoka
6,088,847 A * 7/2000 Burrow ..... 4/579
6,092,870 A 7/2000 Desnoyers et al.
6,241,314 B1 6/2001 Pufall
6,254,490 B1 7/2001 Lawson et al.
6,318,803 B1 11/2001 Garland
6,343,994 B1 2/2002 Clarke
6,412,867 B2 7/2002 Robinson
6,431,646 B1 * 8/2002 Longoria ..... 297/217.3
6,519,792 B2 2/2003 Chen
6,572,189 B1 * 6/2003 Blaymore ..... 297/256.12
6,574,806 B1 6/2003 Maher
6,634,952 B2 10/2003 Kroon
6,676,475 B1 1/2004 Henderson et al.
6,773,016 B2 8/2004 Ochi
6,793,283 B1 * 9/2004 Sipos ..... 297/256.12
6,811,217 B2 11/2004 Kane et al.
6,854,799 B1 2/2005 Asbach et al.
6,932,709 B1 8/2005 Gubitosi et al.
7,073,859 B1 * 7/2006 Wilson ..... 297/256.1
2002/0113469 A1 * 8/2002 Stern et al. ..... 297/256.16
2002/0163232 A1 11/2002 Vezinet et al.
2003/0204907 A1 11/2003 Xu
2005/0101219 A1 5/2005 Paesang
2006/0012230 A1 1/2006 Kennedy et al.
2007/0040431 A1 2/2007 Bapst et al.
2007/0120404 A1 * 5/2007 Bellows et al. ..... 297/256.16

FOREIGN PATENT DOCUMENTS

DE 3834934 A1 4/1990
GB 1163624 9/1969
GB 2312374 A 10/1997
JP 4868367 9/1973
JP 6014819 1/1994
WO 8603108 6/1986
WO 03079861 A1 10/2003
WO 2006096712 A2 9/2006
WO 2007056684 A3 5/2007

* cited by examiner

REPOSITIONABLE CHILD SUPPORT DEVICE

CROSS REFERENCE TO RELATED APPLICATION

This application claims priority under 35 U.S.C. §119(e) to U.S. Provisional Application No. 60/778,065, filed Mar. 2, 2006 and entitled "Repositionable Child Support Device", the disclosure of which is hereby incorporated by reference in it entirety.

FIELD OF THE INVENTION

The present invention is directed toward a child support device and, in particular, to an infant glider including a repositionable seat.

BACKGROUND OF THE INVENTION

Child receiving seats are often used to soothe a restless child. For example, bouncers and swings provide a gentle rocking motion to the seat, comforting the infant positioned therein. Similarly, infant gliders include a seat that moves back and forth along a base to provide a continuous, oscillating motion that comforts a child positioned in the seat. Current gliders, however, are unidirectional—the seat is capable of being positioned in only one direction with respect to the direction of seat oscillation. Consequently, as the glider moves, the child faces only one direction (e.g., the child faces forward as the seat glides in a back to front motion). It would be desirable to provide a glider with a seat that is capable of multiple orientations, wherein a child can face multiple directions during the motion of the toy to heighten the soothing experience.

SUMMARY OF THE INVENTION

The present invention generally relates to a repositionable child support device and, more specifically, to an infant glider including a base, a carriage moveable with respect to the base (in an oscillating, gliding motion), and a seat supported above the base capable of being rotated from a first seat facing position to a second seat facing position, and vice versa.

BRIEF DESCRIPTION OF THE DRAWINGS

Like reference numerals have been used to identify like elements throughout this disclosure.

DETAILED DESCRIPTION OF THE INVENTION

Figure 1:
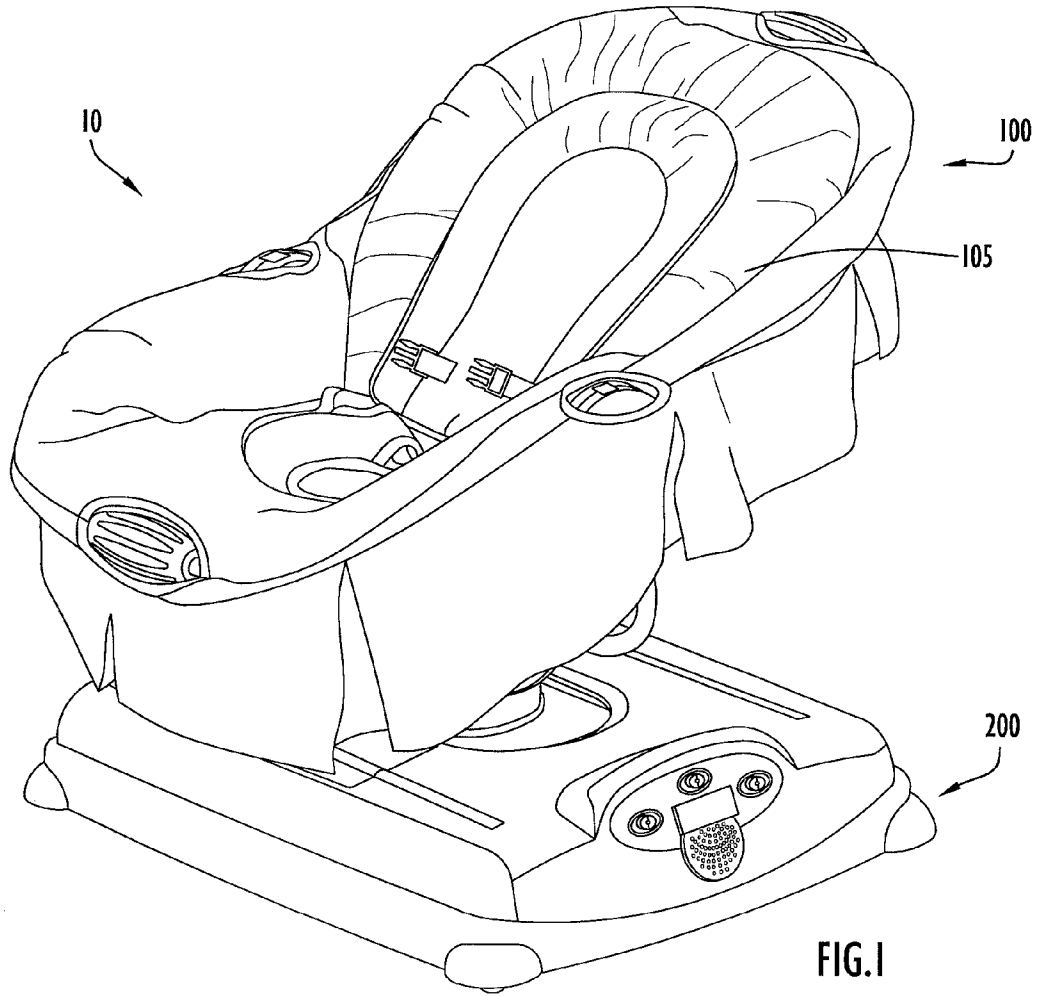
FIG. 1 illustrates a perspective view of a repositionable child support device according to an embodiment of the present invention, showing the seat of the child support device oriented in a side facing position.
Figure 2:
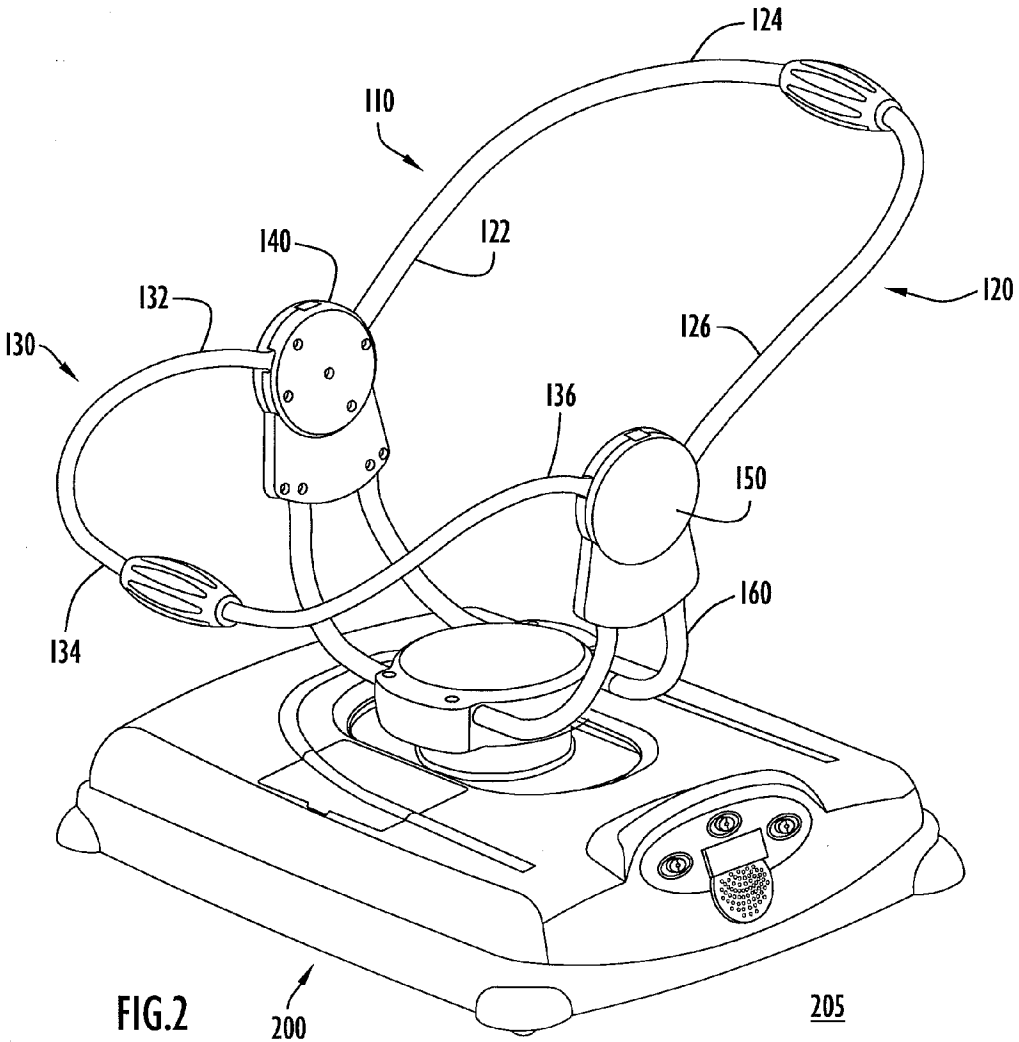
FIG. 2 illustrates a perspective view of the child support device shown in FIG. 1, with the soft goods material removed to reveal the seat frame.

In accordance with the present invention, a child support device is disclosed. FIG. 1 is a perspective view of the child support device according to an embodiment of the present invention. As shown, the child support device 10 includes a child-receiving or seat portion 100 and a base portion 200. The seat portion 100 comprises a structure operable to support an infant above the base 200. The seat portion 100 may include soft goods material 105 draped over a frame 110 (the frame is best seen in FIG. 2). The frame 110 may be formed from generally rigid material including, but not limited to, metal and plastic. The soft goods material 105 (e.g., a soft fabric formed from natural or synthetic materials) is typically draped over the sections of the frame 110 to provide a seating region capable of supporting an infant in a seated and/or a supine position. The soft goods material 105 may be designed to fit securely and snugly onto the sections of the frame 110. The soft goods material 105, moreover, may be removable and washable.

FIG. 2 is a perspective view of the child support device 10 with the soft goods material 105 removed from the frame 110 for clarity. As illustrated, the frame 110 may include an upper section 120 and a lower section 130. The upper frame section 120 may comprise a U-shaped bar including a first end 122, a curved intermediate portion 124, and a second end 126. Similarly, the lower frame section 130 may comprise a U-shaped bar including a first end 132, a curved intermediate portion 134, and a second end 136. One or both of the frame sections 120, 130 may further comprise a slight downward bend along its curved intermediate portion 124, 134 (i.e., along the bend of the "U"). That is, the intermediate portions 124, 134 may be canted (bent) slightly downward (toward the base 200 and/or supporting surface 205). For example, the intermediate portions 124, 134 may be canted at an angle of approximately 30° with respect to the ends 122, 126, 132, and 136. This configuration provides a deeper seat pocket (created by the soft goods 105 on frame 110) when compared to conventional child seats (without the canted frame sections), thus providing a more comfortable resting place for a child. Additional details regarding the canting of the child seat are provided in U.S. Published Patent Application No. 2004-0217643 (Piwko et al.), the disclosure of which is herein incorporated by reference in its entirety.

Each frame section 120, 130 couples to a pair of connection members or hubs 140, 150, which, in turn, couples the frame 100 to the base 200. The hubs 140, 150 include receptacles operable to receive and secure at least a portion of each of the ends 122, 126, 132, and 136 therein. Specifically, the first ends 122, 132 are received by a first hub 140 and the second ends 126, 136 are received by a second hub 150. The upper and lower sections 120, 130 of the frame 110 may be secured to the hubs 140, 150 in any conventional manner (friction fit, spring biased tabs, fasteners, etc). When secured to the hubs 140, 150, the upper section 120 of the frame 110 may be positioned such that it is tilted from a generally vertical axis, while the lower section 130 may be positioned generally parallel to the supporting (horizontal) surface 205. With this configuration, the upper section 120 of the frame 110 forms the support for the head and torso of a child, while the lower section 130 of the frame 110 forms a support area for the legs and feet of a child.

Figure 3:
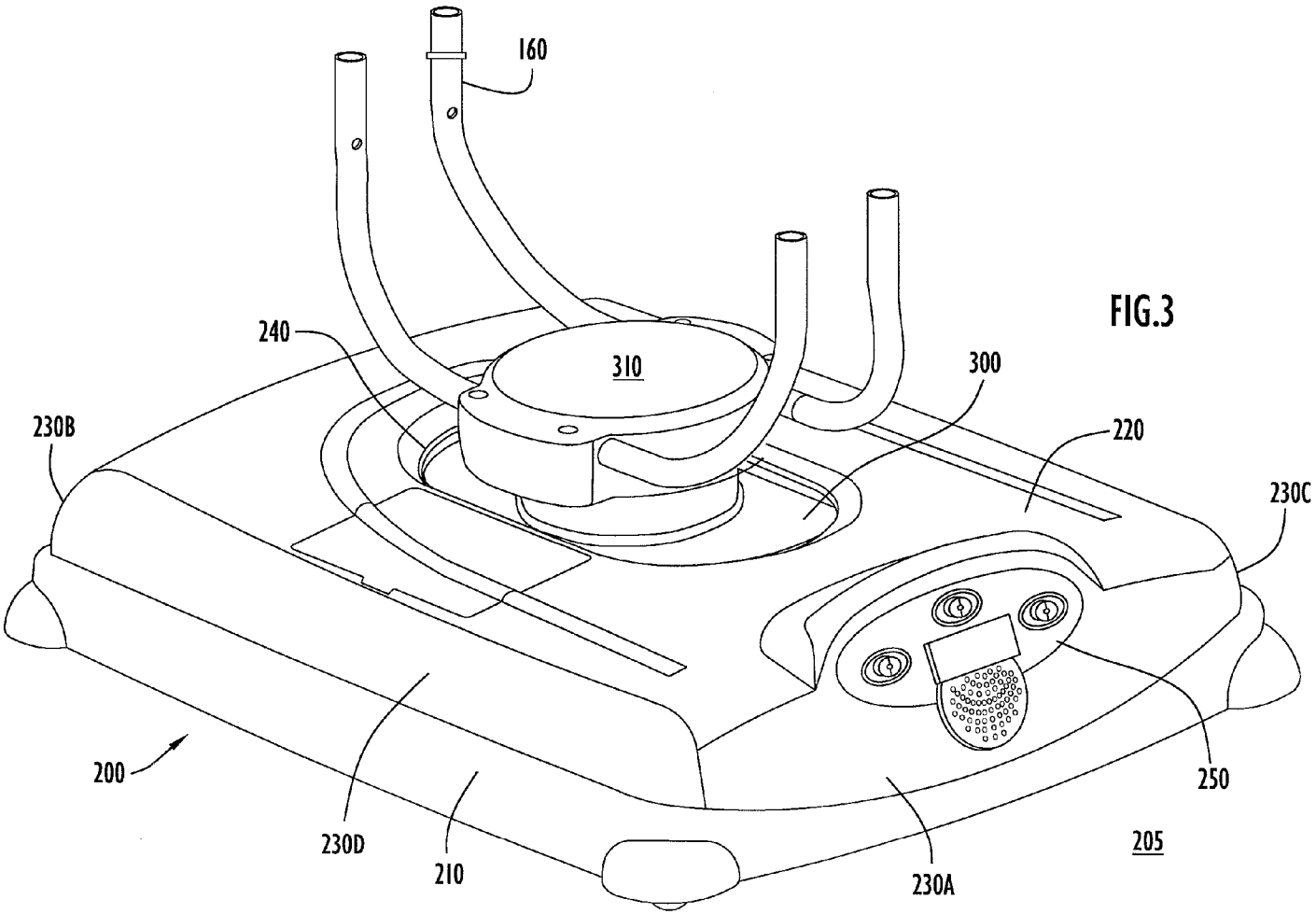
FIG. 3 illustrates a perspective view of the child support device shown FIG. 2, with the upper part of the seat frame seat removed.

FIG. 3 is perspective view of the base 200 with the frame 110 removed for clarity. The base 200 includes a structure operable to support the seat portion 100 above a supporting surface 205. In the embodiment shown, the base includes a housing 210 and a carriage or platform 300 adapted to move with respect to the housing. The housing 210 and carriage 300 may be formed from any suitable materials including, but not limited to, plastic, metal, wood, etc. The housing 210 may be of any size and/or shape; however, by way of example only, the housing 210 is illustrated herein as having a substantially rectangular shape with a top surface 220 and four generally vertical sidewalls—a front wall 230A, a rear wall 230B, a first side wall 230C, and a second side wall 230D. A switch plate 250, housing the various operational switches (discussed in detail below), is incorporated into the front wall 230A of the housing 210. The seat portion 100 is fixed to the carriage 300, which, in turn, is movably coupled the housing 210. Specifically, a pedestal assembly 310 extends from the upper surface of the carriage 300 and through an opening 240 formed into the top surface 220 of the housing 210. The opening 240 defines the general limits through which the seat portion 100 may travel with respect to the housing 210 (i.e., the opening defines the predetermined travel path of the seat portion 100). The pedestal assembly 310 is connected to the seat portion 100 via one or more connection rods 160.

Figure 4:
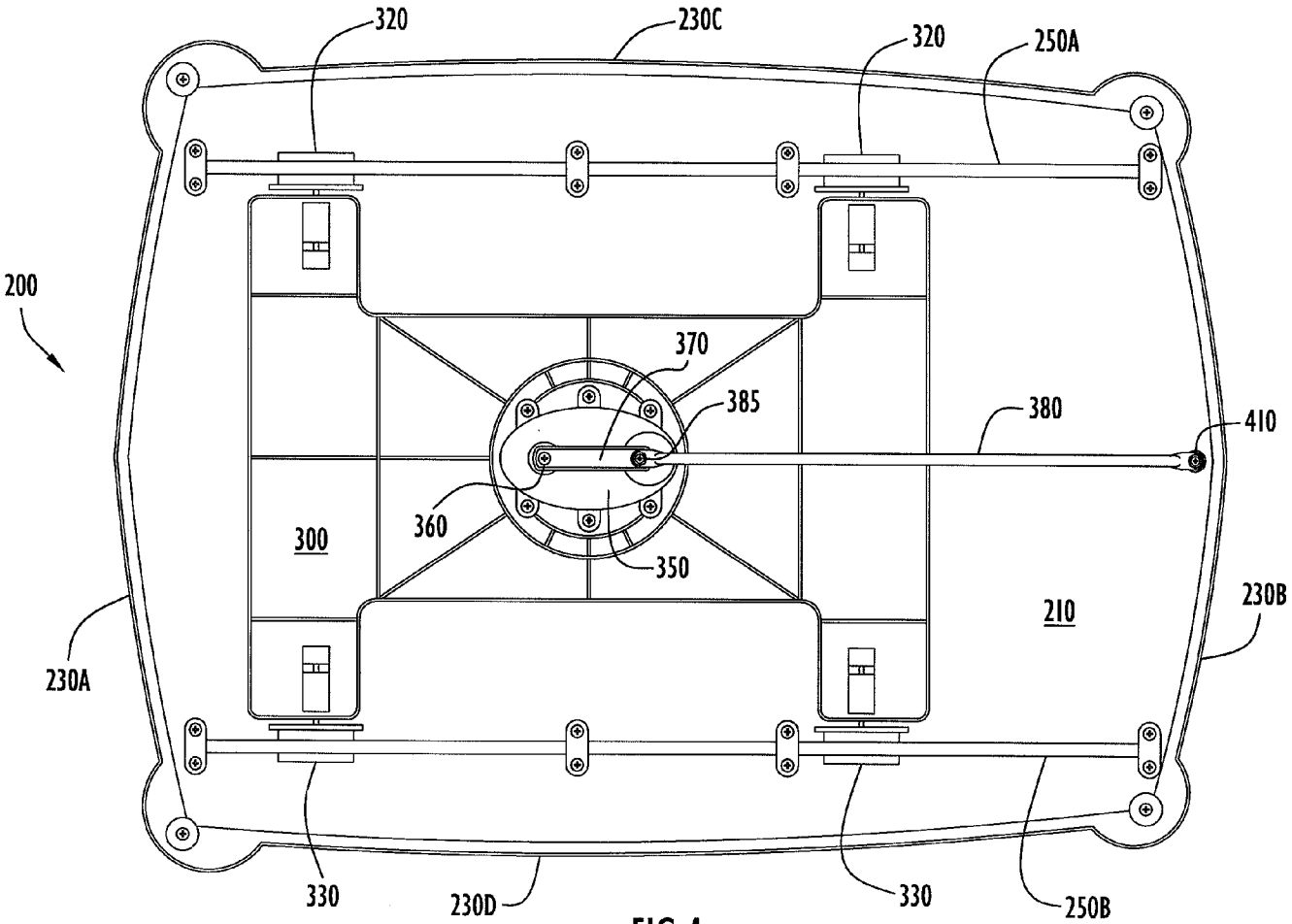
FIG. 4 illustrates a bottom view of the child support device shown in FIG. 1, showing the motor-driven, oscillating glider carriage.

As indicated above, the carriage 300 is adapted to move with respect to the housing 210 (and thus the supporting surface 205). FIG. 4 is a bottom plan view of the base 200 illustrated in FIG. 3. As shown, the housing 210 contains a first track 250A and a second track 250B spaced in parallel relation and extending from the front wall 230A to the rear wall 230B. The carriage 300, moreover, includes a first pair of wheels 320 and a second pair of wheels 330. The first pair of wheels 320 is adapted to move (roll) along the first track 250A; similarly, the second pair of wheels 330 is adapted to move (roll) along the second track 250B. The carriage 300 is driven along the tracks via a drive assembly. The drive assembly may include a motor 350 disposed proximate the center of the carriage 300. The motor 350 may comprise any motor operable to generate suitable motion of the carriage. By way of specific example the motor may comprise a normal magnet motor (RF-500TB motor, available from Mabuchi Motor Co., Ltd., Troy, Mich. (www.mabuchi-motor.co.jp)). The motor 350 rotates a generally vertical shaft 360 coupled to a crank 370. The crank 370 has one end fixed to the shaft 360 and its other end pivotally connected to a rod 380 at point 385. The rod 380, in turn, is pivotally connected to the housing 210 along the inner surface of the rear wall 230B at point 410. In operation, the motor 350 rotates the shaft 360, causing a corresponding rotation in the crank 370 about the shaft.

Figure 5A:
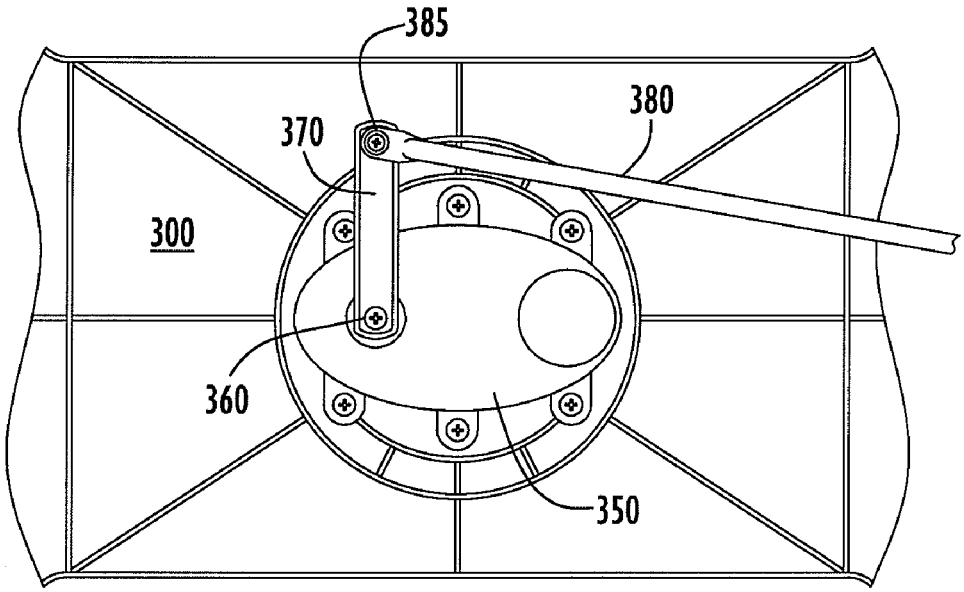
FIGS. 5A and 5B illustrate close-up views of the glider carriage of FIG. 4, showing the driving mechanism operable to move the carriage from a first carriage position to a second carriage position.
Figure 5B:
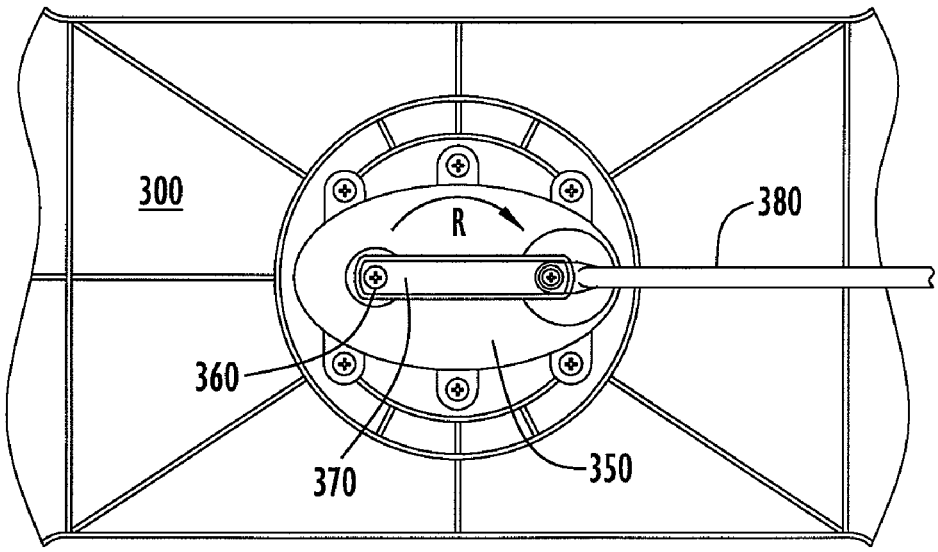

FIGS. 5A and 5B are close-up views of the motor 350, showing the rotation of the crank 370 by the shaft 360. As the motor drives the crank 370 (indicated by arrow R in FIG. 5B), the crank applies a pushing/pulling force to the rod 380, causing the wheeled carriage 300 to be pulled along the tracks, i.e., the rod 380 pulls the carriage 300 toward the rear wall 230B or pushes the carriage away from the rear wall (and toward the front wall 230A). In this manner, the carriage 300 is driven such that it rolls along the tracks 250A, 250B of the housing 210 in a back-and-forth, gliding motion. As explained above, the seat portion 100 connects to the carriage 300 via the pedestal 310; consequently as the carriage 300 moves, the seat portion 100 oscillates (front to back) with respect to the housing 210 (discussed in greater detail below).

Figure 6:
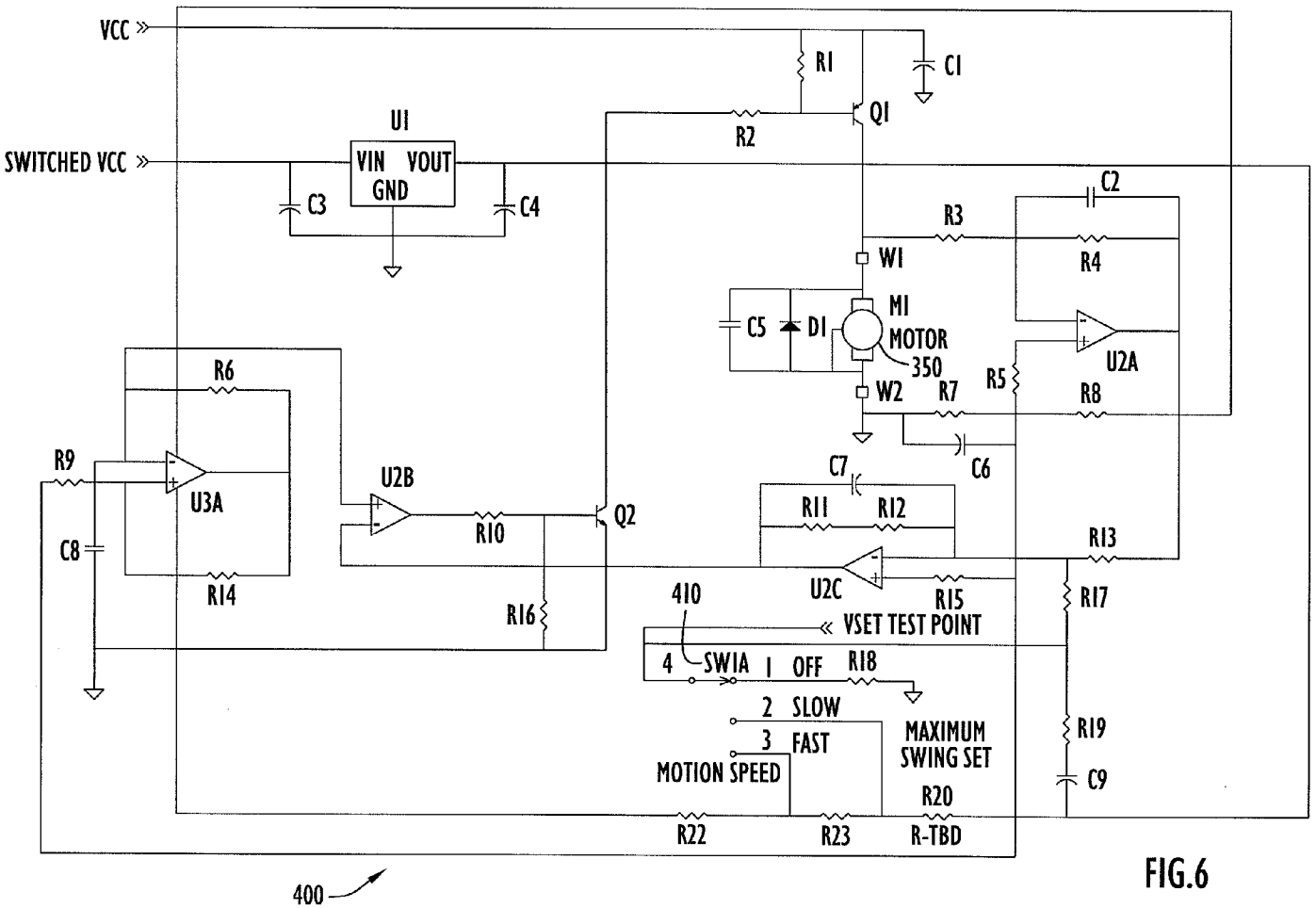
FIGS. 6 and 7 illustrate schematic diagrams of the electronics assembly according to an embodiment of the present invention.
Figure 7:
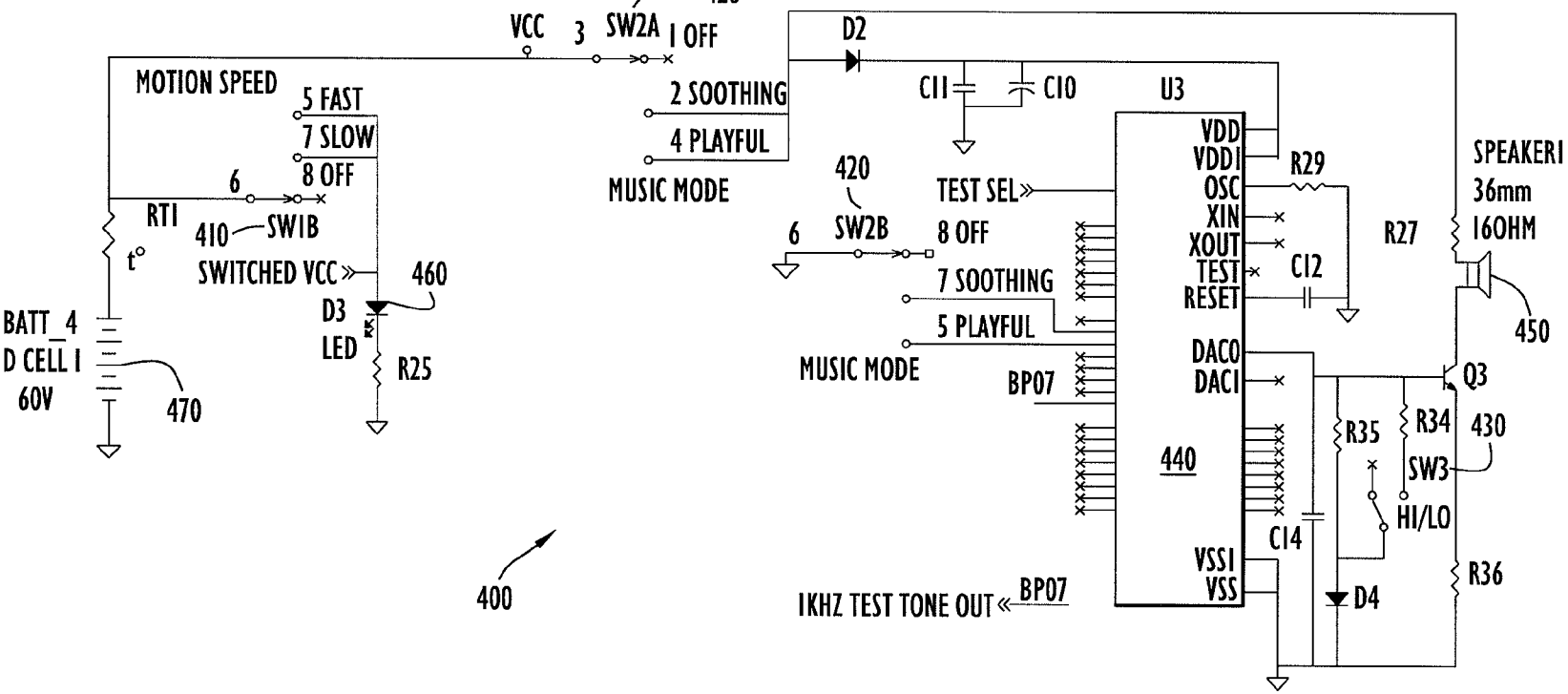

The housing 210 may further include an electronics assembly 400 adapted to control the motor 350, as well as to generate sensory stimulating output. FIGS. 6 and 7 collectively represent schematic diagrams of the electronics assembly 400 according to an embodiment of the present invention. Generally, the electronics assembly 400 may include a control unit having one or more switches or actuators that correspond to the various interactive features of the child support device 10. Each switch may comprise, but is not limited to, a mechanical switch (pressure sensitive, contact, push, pivot, and slide), an electrical switch, a magnetic switch, an optical switch, etc. The number of switches is not limited that that which is illustrated herein. By way of example, as shown in FIGS. 6 and 7, the electronics assembly 400 may include a first switch 410 (SW1A/SW1B), a second switch 420 (SW2A/SW2B), and a third switch 430 (SW3), each in communication with a control unit 440.

The first switch 410 (comprising switch poles SW1A and SW1B), may be configured to provide power to the control unit 440 of the child support device 10 (i.e., to turn the device 10 on and to provide power to speaker, etc.), as well as to control the parameters of the motor 350, e.g., to set the speed at which the motor 350 rotates the post 360 and, as such, the oscillatory speed of the carriage 300 and the seat portion 100. By way of example, the speed control unit can be any suitable control circuit capable of varying the current to the motor 350, such as a pulse width modulation control, a rheostatic control, etc. The second switch 420 (comprising switch poles SW2A and SW2B) may be configured to alter the sensory output of the child support device 10, e.g., by changing the type of music generated by the control unit 440. The third switch 430 (SW3) may be configured to adjust the output volume of the speaker 450 (hi/lo). The child support device 10 may also include sensory output generating devices including, but not limited to, a speaker 450 (e.g., a 0.25 W, 50 mm, 16 ohm speaker and lights 460) and lights (e.g., grain of wheat (GOW) or light emitting diodes (LEDs)). The electronics assembly 400 of the child support device 10 may further include a power source 470. The power source may comprise a direct current source or alternating current source (e.g., a standard outlet plug or four "D-cell" batteries).

The motor 350, each of the switches 410, 420, 430, the speaker 450, the lights 460, and the power source 470 are each operatively connected to the control unit 440, which is capable of producing switch-specific electronic output. The type of control unit 440 is not limited to that which is illustrated herein, and may include microcontrollers, microprocessors, and other integrated circuits. By way of specific example, the control unit 440 may comprise a speech and melody processor (e.g., the W567S120 processor, available from Winbond Electronics Corporation of America, San Jose, Calif. (www.winbond-usa.com)). The control unit 440 recognizes and controls signals generated by the various switches 410, 420, 430, as well as generates and controls operational output directed through various sensory generating devices (e.g., the motor 350, the speaker 450, and the lights 460). The control unit 440 continually monitors the electronic status of the various switches, generating and altering the sensory output (e.g., movement, sounds, and/or lights) accordingly.

Figure 8:
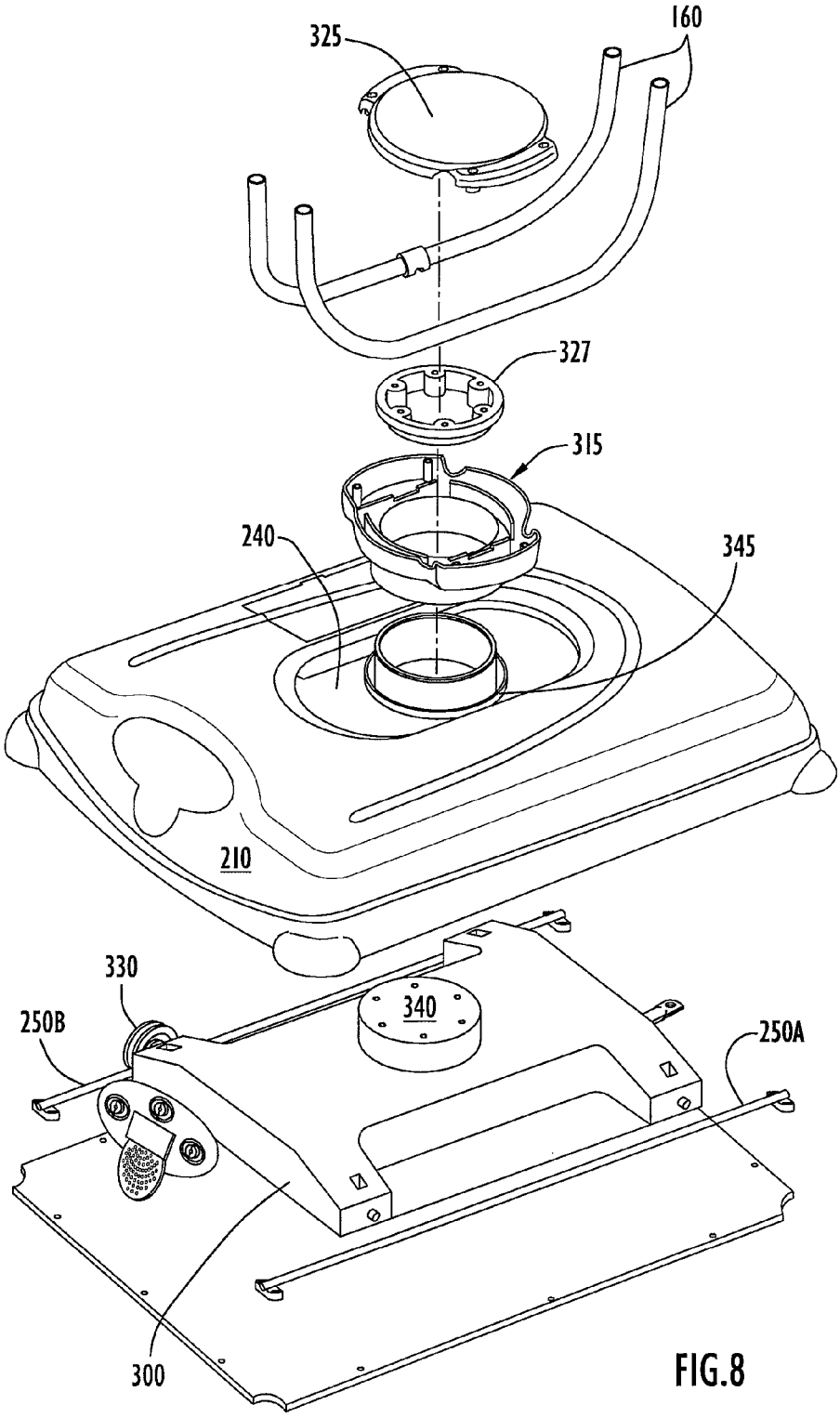
FIG. 8 illustrates an exploded view of the base and carriage of the child support device of FIG. 1, showing the seat reorientation mechanism.

In addition to being configured to move with respect to the base, the seat portion 100 of the child support device 10 is further configured for reorientation. Specifically, the seat portion 100 is adapted to rotate from a first seat-facing position to a second seat-facing position, and vice versa. FIG. 8 is an exploded view of the base 200 and pedestal assembly 310 of the child support device 10, showing the seat reorientation mechanism in accordance with an embodiment of the invention. As illustrated, the pedestal assembly 310 includes a generally annular collar 315 coupled to a cap 325 such that the connection rods 160 extending from the hubs 140, 150 are captured therebetween. The cap 325 may couple to the collar 315 in any conventional manner (fasteners, etc.). By way of specific example, a retainer 327 may be disposed within the collar to receive fasteners that secure the cap 325 to the collar 315.

The collar 315 is configured to extend through the opening 240 of the housing 210 and slidingly engage a boss 340 extending up from the upper surface of the carriage 300. A washer 345 may be captured between the collar 315 and the boss 340, providing a desired degree of friction between the boss 340 and the collar 315. With this configuration, the collar 315 may be rotated about the boss 340 in any degree of rotation (0° to 360°) by simply applying a rotary force to the collar 315 (via application of rotational force to the seat portion 100). The amount of friction between the collar 315 and the boss 340 should be sufficient to maintain the collar stationary until the amount of rotational force necessary to overcome the weight of the child in the seat portion 100 is applied.

Figure 9:
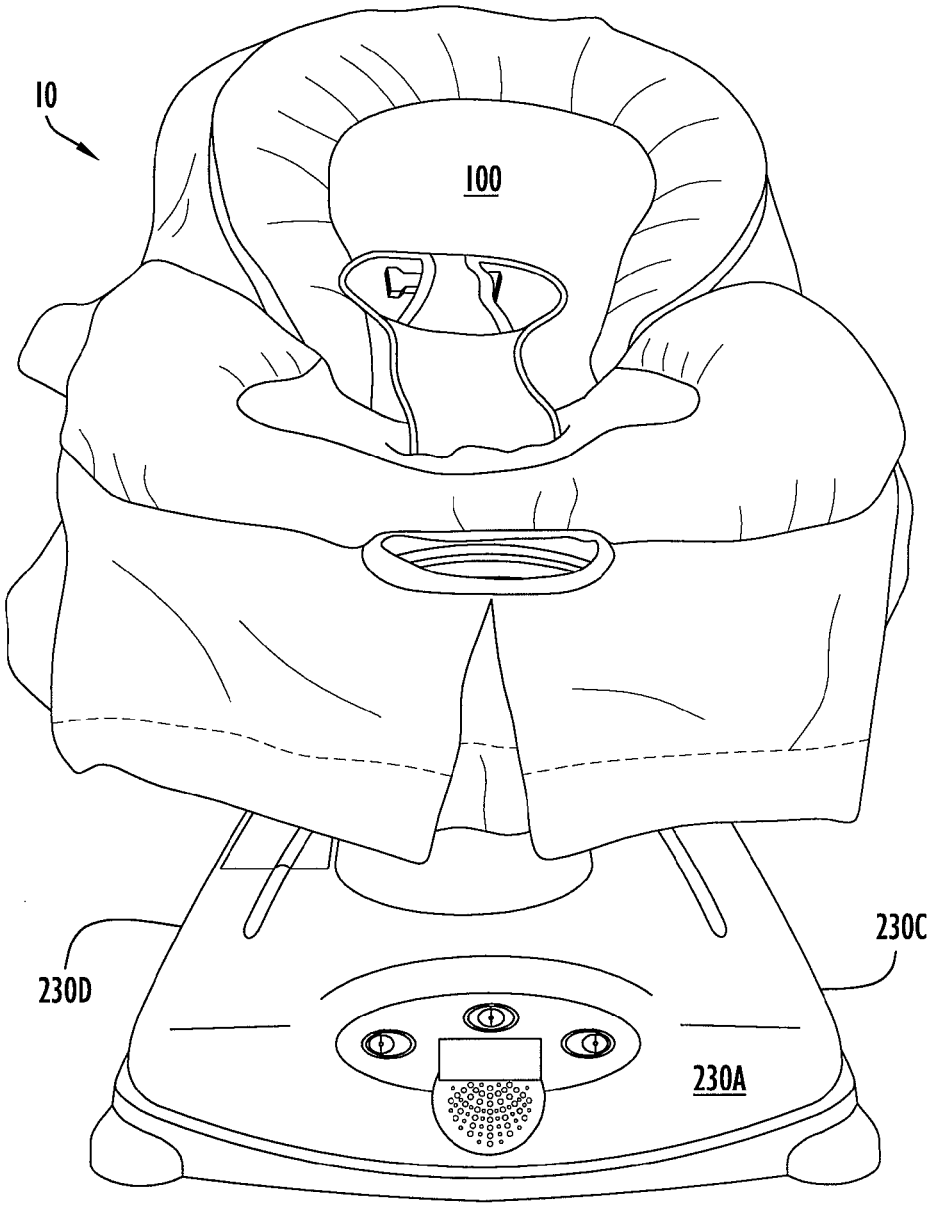
FIGS. 9-10 illustrate perspective views of the child support device of FIG. 1, showing engagement of the seat reorientation mechanism to reorient the seat from a first seat facing position to a second seat facing position.
Figure 10:
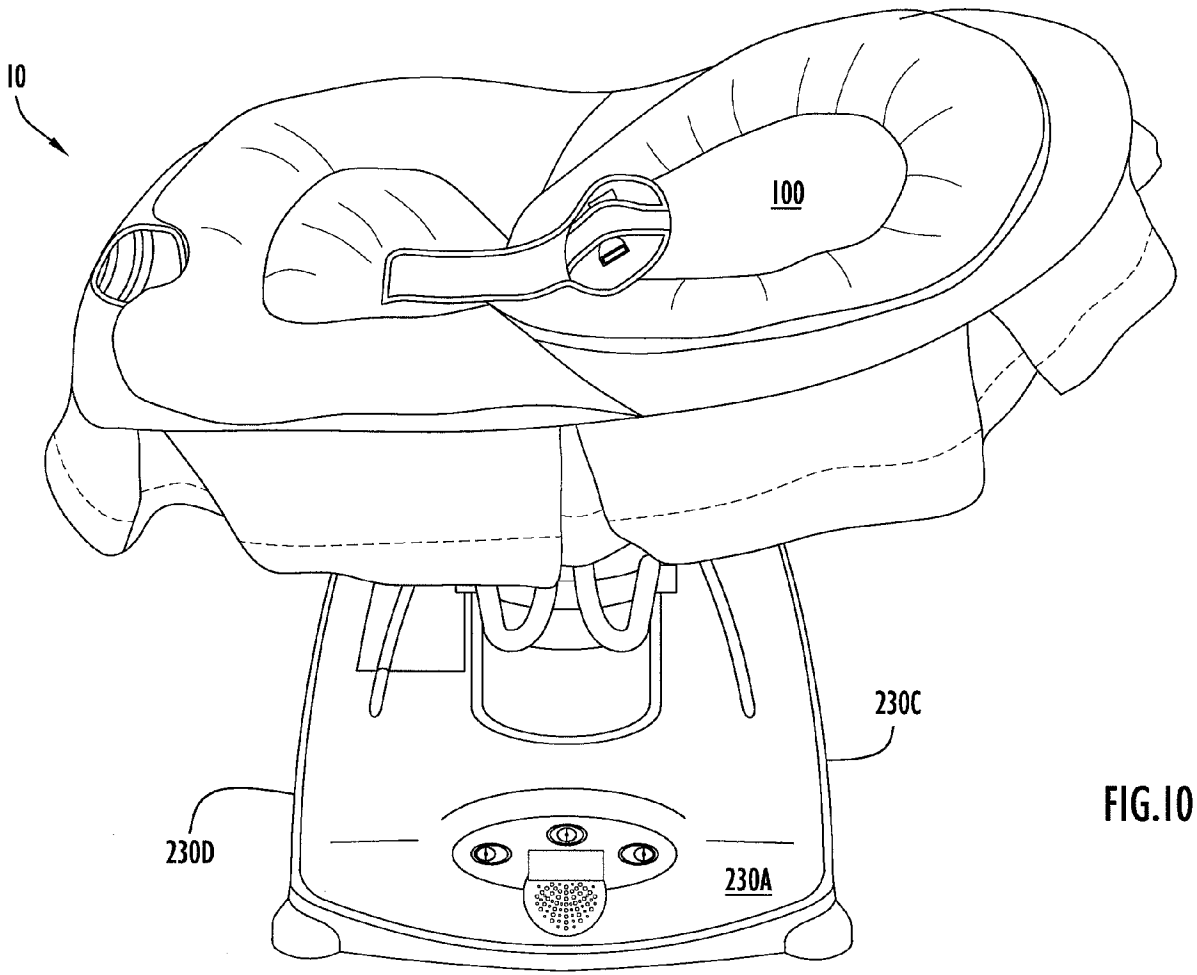

FIGS. 9 and 10 are front perspective views of the child support device 10 of FIG. 1. With the above-described configuration, the orientation of the seat portion 100 of the child support device 10 may be altered. For example, the seat portion may be moved from a first seat-facing position, in which the seat portion 100 faces forward (e.g., toward the front wall 230A of the housing 210 as illustrated in FIG. 9), to a second seat-facing position, in which the seat faces sideways (e.g., toward second side wall 230D of the housing 210 as illustrated in FIG. 10). This seat reorientation enables a parent to position a child supported on the seat portion 100 in any desired direction. Thus, when the seat portion 100 is positioned such that the child faces forward and the motor is activated, the child will experience a front-to-back motion (as in FIG. 9). Alternatively, when the seat portion 100 is positioned such that the child faces sideways (FIG. 10), the child will experience a side-to-side motion (as in FIG. 10).

In this manner, the seat portion 100 may be reoriented with respect to the base 200 while coupled thereto; furthermore, the drive assembly may be engaged to drive the seat portion along its travel path, regardless of the orientation of the seat. The child support device 10 of the prevent invention further permits a parent to easily position a child such that the parent can see him/her, providing not only for the child's comfort, but assisting a parent in monitoring the child.

While the invention has been described in detail and with reference to specific embodiments thereof, it will be apparent to one skilled in the art that various changes and modifications can be made therein without departing from the spirit and scope thereof. For example, the child support device 10 can be of any size and shape. Any seat suitable to support a child may be used. The material comprising the frame 110 is not limited to that illustrated herein, and may include tubes comprising metal (e.g., aluminum or steel). The electronics assembly 400 in accordance with the present invention may include any combination of sensors, switches, lights, speakers, animated members, motors, and sensory output generating devices. The control unit 440 may produce any combination of audio and visual effects including, but not limited to, animation, lights, and sound (music, speech, and sound effects). The output pattern is not limited to that which is discussed herein and includes any pattern of music, lights, and/or sound effects. The electronics assembly 400 may also include additional switches or sensors to provide additional sensory output activation without departing from the scope of the present invention.

The seat portion 100 may be rotationally reoriented about an axis generally perpendicular to the base 200 (as described above) in any desired degree including, but not limited to, 360° of rotation. For example, the seat portion may rotate about a generally vertical axis, rotating approximately 90° from the first seat facing position to the second seat facing position. Although first and second seat facing positions are illustrated, the device 10 may be configured for additional seat facing positions. Additionally, the seat portion 100 may be adapted to pivot about a generally horizontal axis to provide a seat recline feature.

The type of seat position reorientation mechanism is not particularly limited to that depicted herein, and includes mechanisms operable to permit the repositioning of the seat about an axis generally perpendicular to the base. The rotation of the seat portion 100 may be secured via friction (as described above), or may be secured by a lock mechanism operable to secure the seat in any desired position (e.g., with the seat portion 100 facing the front, side, or back walls of the housing 210). With regard to the disclosed embodiment, the boss 340 and collar 315 may comprise any size and shape sufficient to permit the reorientation of the seat portion 100 with respect to the base 200.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A child support device comprising:

a base to support the device on a supporting surface;

a carriage housed in the base, wherein the carriage is operable to move within the base;

a seat coupled to the carriage such that the carriage supports the seat; and a drive assembly to drive the carriage along a predetermined path such that the seat moves in an oscillatory gliding motion with respect to the base, wherein the seat is configured to rotate about an axis oriented generally perpendicularly to the base from a first seat facing position to a second seat facing position, and vice versa, and wherein the carriage remains housed within the base while traveling alone the predetermined path.

2. The child support device of claim 1, wherein the seat is adapted to rotate 360° about the axis.

3. The child support device of claim 1, wherein the predetermined path is generally parallel to at least one of the supporting surface and the base.

4. The child support device of claim 1, wherein:

the predetermined path is defined by tracks coupled to the base; and the carriage includes wheels adapted to roll along the tracks.

5. The child support device of claim 1, wherein the reorientation of the seat about the axis is provided via a reorientation mechanism mounted between the seat portion and the base.

6. The child support device of claim 5, wherein the reorientation mechanism comprises a boss mounted to the carriage and a collar mounted to the seat portion, wherein the collar is configured to slidingly engage the boss.

7. The child support device of claim 1, wherein the drive assembly comprises a motor operable to rotate a crank connected to a rod fixed to the base, wherein the rotation of the crank drives the carriage along tracks.

8. The child support device of claim 1, wherein the seat comprises a frame including:

a substantially U-shaped upper frame, the upper frame including a medial portion and two substantially parallel, side portions attached thereto, the medial portion being canted toward the base;

a substantially U-shaped lower frame, the lower frame including a medial portion and two substantially parallel, side portions attached thereto, the medial portion being canted toward the base; and soft goods material disposed on the frame.

9. The child support device of claim 1, wherein the drive assembly comprises a motor operable to rotate a crank connected to a rod fixed to the base, wherein the rotation of the crank drives the carriage along the predetermined path.

10. The child support device of claim 1 further comprising an electronics unit configured to generate sensory stimulating output.

11. The child support device of claim 1, wherein the rotational reorientation is provided by a reorientation mechanism disposed between the seat portion and the carriage.

12. The child support device of claim 11, wherein the reorientation mechanism comprises a boss and a collar configured to slidingly engage the collar.

13. The child support device of claim 1, wherein, in the first seat facing position, an infant placed in the seat experiences a front-to-back motion and, in the second seat facing position, the infant experiences a side-to-side motion.

14. The child support device of claim 1, wherein the seat rotates approximately 90° from the first seat facing position to the second seat facing position while coupled to the base.

15. A method of repositioning a child in a child support device comprising the steps of:

(a) obtaining a child support device including:

a base to support the child support device on a supporting surface, a carriage configured to move within the base, a seat coupled to the carriage, and a drive assembly operable to drive the carriage along a predetermined path to move the seat in an oscillatory, gliding motion, wherein the carriage remains within the base while traveling along the predetermined path;

(b) orienting the seat in a first seat facing position with respect to the base; and (c) rotationally reorienting the seat from the first seat facing position to a second seat facing position.

16. The method of claim 15 further comprising the step of (d) rotationally reorienting the seat from the second seat facing position to a third seat facing positing, wherein the third seat facing position differs from the first seat facing position and the second seat facing position.

17. The method of claim 15, further comprising:

(d) engaging the drive assembly to drive the seat along the predetermined path while the seat is in the first seat facing position; and (e) engaging the drive assembly to drive the seat along the predetermined path while the seat is in the second seat facing position.

18. A child support device comprising:

a base to support the device on a supporting surface, the base defining a perimeter;

a carriage configured to move within the base perimeter;

a seat coupled to the carriage; and a drive assembly to drive the carriage along a predetermined path and to generate an oscillatory, gliding motion of the seat with respect to the base, wherein the seat rotates with respect to the carriage about an axis oriented generally perpendicularly to the base from a first seat facing position, in which the child experiences front-to-back motion, to a second seat facing position, in which the child experiences a side-to-side motion, and wherein the carriage remains within the perimeter of the base while traveling along the predetermined path.

19. The child support device of claim 18, wherein the seat is coupled to the carriage such that it is supported over the base and the carriage.

20. The child support device of claim 18, wherein:

the predetermined path is defined by tracks coupled to the base;

the carriage includes wheels adapted to roll along the tracks;

the drive assembly comprises a motor operable to rotate a crank connected to a rod fixed to the base; and the rotation of the crank drives the carriage along tracks.

* * * * *

UNITED STATES PATENT AND TRADEMARK OFFICE

CERTIFICATE OF CORRECTION

PATENT NO. : 7,722,118 B2
APPLICATION NO. : 11/680919
DATED : May 25, 2010
INVENTOR(S) : Bapst et al.

It is certified that error appears in the above-identified patent and that said Letters Patent is hereby corrected as shown below:

Column 6, line 50, Claim 1, change “alone” to --along--.

Column 6, line 64, Claim 5, remove “portion”.

Column 7, line 1, Claim 6, remove “portion”.

Column 7, line 28, Claim 11, remove “portion”.

Signed and Sealed this
Twenty-ninth Day of January, 2013

David J. Kappos

David J. Kappos
*Director of the United States Patent and Trademark Office*